United States Patent [19]

Tompkins

[11] 4,191,139

[45] Mar. 4, 1980

[54] ENGINE WITH SECONDARY PISTONS

[76] Inventor: Vincent J. Tompkins, Allview Ave., R.D. 5, Brewster, N.Y. 10509

[21] Appl. No.: 912,179

[22] Filed: Jun. 5, 1978

[51] Int. Cl.[2] ..... F02B 75/04

[52] U.S. Cl. ..... 123/48 A; 123/78 A

[58] Field of Search ..... 123/78 A, 48 A, 48 AA, 123/48 B

[56] References Cited

U.S. PATENT DOCUMENTS

| | | | |
|---|---|---|---|
| 1,489,004 | 4/1924 | Powell | 123/78 A |
| 1,654,701 | 1/1928 | Powell | 123/78 A |
| 2,563,885 | 8/1951 | Tatter | 123/78 A |
| 2,981,243 | 4/1961 | Arndt | 123/78 A |
| 3,741,175 | 6/1973 | Rouger | 123/78 A |

*Primary Examiner*—Ira S. Lazarus

*Attorney, Agent, or Firm*—Spellman, Joel & Pelton

[57] ABSTRACT

An engine producing combustion of a fuel by compression rather than ignition comprises a conventional engine cylinder having a pair of opposed secondary cylinders mounted side-by-side on the upper portion of the cylinder chamber. The secondary cylinders are driven by a cam arrangement in a direction transverse to the action of the main engine cylinder and at predetermined synchronized time intervals. The secondary pistons operate in conjunction with the main piston entering the respective compression chambers on the 0° top dead center system of the main piston to produce combustion by compression thereby eliminating the need for electric ignition and providing more power per cylinder. As further advantage, there is less pollution due to more efficient combustion in an arrangement which also eliminates the necessity for engine tuneups.

2 Claims, 7 Drawing Figures

0° top dead center

10° before top center

10° after top dead center (compression stroke)

5° after top dead center (explosion occurs)

ENGINE WITH SECONDARY PISTONS

BACKGROUND OF THE INVENTION

This invention relates to piston engines and particularly to an improved engine having secondary cylinders mounted on the cylinder head to produce combustion.

The prior art disclosed in a patent search includes U.S. Pat. No. 1,789,587 to C. F. Heywood which discloses an auxiliary starting means for an internal combustion engine rather than an integral cylinder arrangement involving secondary pistons. In U.S. Pat. No. 2,581,600 to R. P. Pescara, a free piston motor compressor of the single action motor system type is disclosed which shows a pair of opposed pistons concerned with variations in the amount of air delivered to the pistons. In contrast to the present invention, the patent discloses supercharging means, a blower, etc., in an arrangement and environment substantially different from that of the present invention.

In U.S. Pat. No. 2,924,068 to C. V. Pereda, a further variation of the free piston engine hydraulic system is disclosed which is also not pertinent to the present invention aside from the fact that opposed pistons are utilized in an engine. The pistons, noticeably, move within the same cylinder walls. In Bayer U.S. Pat. No. 3,016,689 a free piston diesel cycle gasifier is shown which is designed to reduce the stroke of the engine during low load conditions. The patent to Bayer involves a complicated engine arrangement which is essentially dissimilar and incompatible with present invention.

U.S. Pat. No. 3,119,230 to H. Kosoff discloses a free piston engine system designed to convert the output energy thereof to hydraulic pressure for operating hydraulic pressure driven apparatus. Another Kosoff U.S. Pat. No. 3,127,881 discloses a free piston engine wherein snychronization of pistons is achieved by a novel system of pneumatic control. Opposed pistons move within a single chamber in contradistinction to the invention disclosed herein. Finally, U.S. Pat. No. 3,363,609 to J. Cadiou discloses a liquid fuel injection device for free piston internal combustion engines which is merely of general interest.

In summary, none of the above patents discloses the particular piston arrangement with secondary cylinders proposed by applicant to provide a more efficient engine. Specifically, applicant has dual opposed cylinders with separate compression chambers mounted side-by-side on the cylinder head which operates in synchronization with the main cylinder. Applicant is able to eliminate the conventional electrical ignition set-up with his secondary cylinders and provide greater efficiency and less pollution, both desired goals in todays times. Also, the present system is relatively simple and inexpensive to produce.

SUMMARY OF THE INVENTION

The present invention relates to a new type engine and particularly to a new and improved engine having a pair of secondary pistons mounted on the upper portion of each cylinder to provide compression for combustion. Each pair of secondary pistons are mounted in an adjacent relationship and controlled by respective eccentric cams so that the compression by the secondary pistons occurs when the engine piston is at fully extended position. The secondary pistons move in opposite directions within separate adjacent chambers to produce the aforementioned combustion.

Accordingly, an object of this invention is to provide a new and improved engine which has greater efficiency and produces less pollution than conventional engines.

A further object of this invention is to produce a new and improved engine which eliminates the need for electrical ignition and the necessity for engine tuneups.

A still further object of this invention is to provide an engine which has combustion caused by compression rather than ignition through the action of opposed secondary cylinders.

A more specific object to this invention is to provide a new and improved engine having a pair opposed secondary pistons mounted on the upper portion of each main engine cylinder to provide combustion at a predetermined time interval compatible with the action of the main engine cylinder.

BRIEF DESCRIPTION OF THE DRAWINGS

Other objects and advantages of the present invention may be seen from the following description when viewed in conjunction with the accompanying drawings wherein.

DETAILED DESCRIPTION OF THE INVENTION

Figure 1:
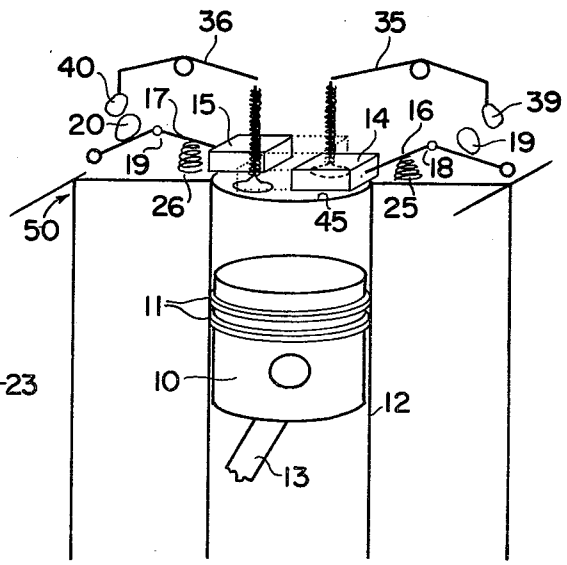
FIG. 1 is a schematic perspective view, partially in cross section, showing the invention.
Figure 2:
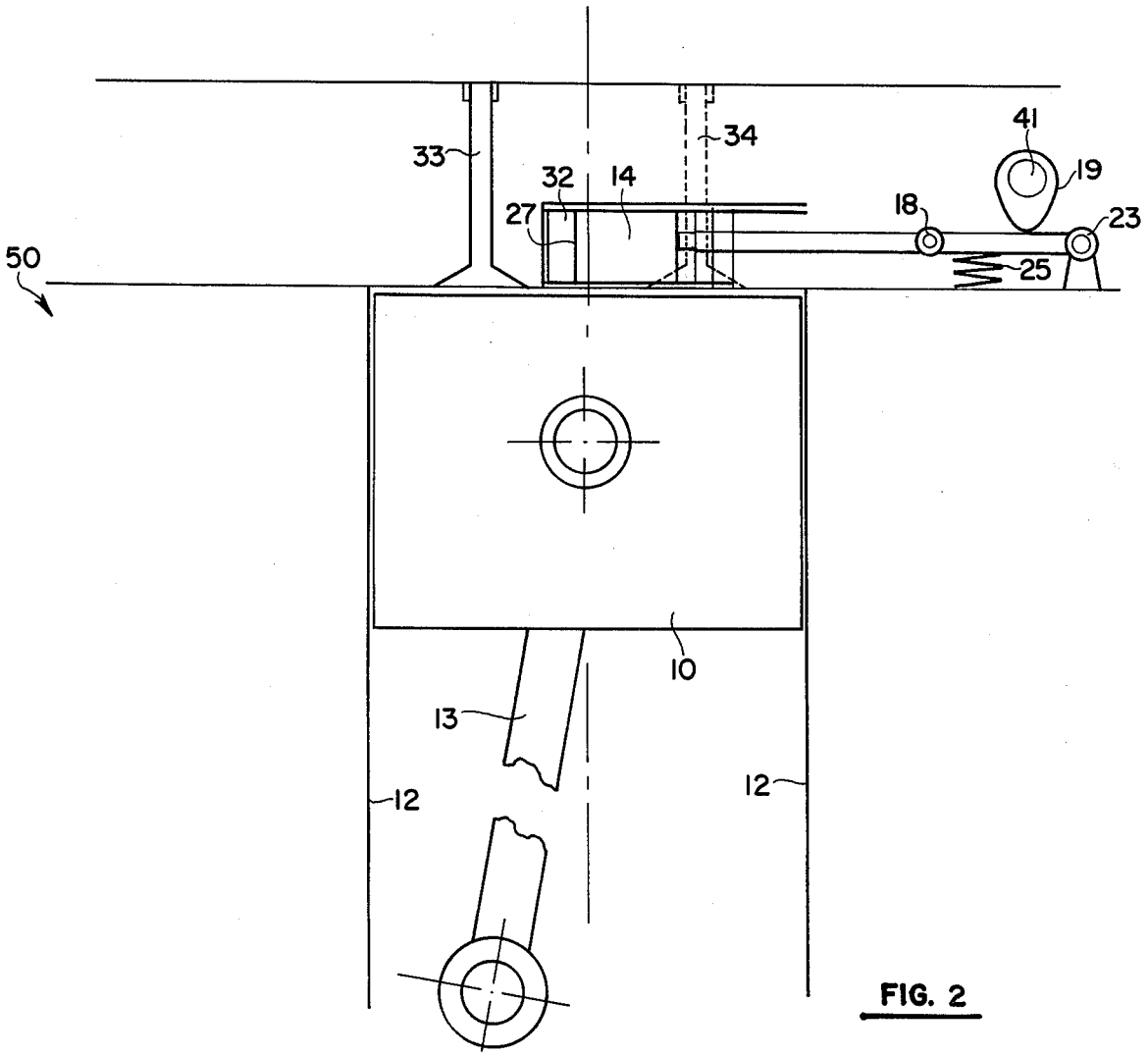
FIG. 2 is a side cross-sectional view of the invention showing the operation of one of the secondary cylinders.

Referring now to the drawings the invention comprises a new type engine having at least one cylinder of the type shown in FIGS. 1 and 2. Generally, the engine would have a plurality of such cylinders arranged in a conventional manner to power an automobile, for example. The drawings illustrate a typical piston 10 having a plurality of rings 11 around the upper surface thereof mounted within the walls 12 of the engine 50. The piston 10 is driven along the walls by the piston rod 13 in a conventional manner.

A pair of secondary pistons 14 and 15 are mounted on the upper surface of the cylinder head 45 in an opposed relationship. Each cylinder, 14 and 15, includes a pivotable piston rod 16 and 17, respectively, which are mounted at 18 and 19 for pivotal motion and driven by an eccentric cam 51 and 20 respectively against the action of springs 25 and 26. The piston rod linkage includes the forward portions 16 and 17 and the rear portions 21 and 22 which are joined to the forward portions at the pivot points 18 and 19 and anchored at the other rearward end to an anchor pivot 23 and 24 respectively. The piston rods 16 and 17 are resiliently urged by the return springs 25 and 26, respectively, to return to their initial position against the urging of the cams 5 and 20.

The piston heads 27 and 28 slide within piston guide bars 29*a* and 29*b* and 30*a* and 30*b* into the compression chambers 31 and 32. The upper surface of the engine cylinder 10 also includes a conventional exhaust valve 33 and an intake valve 34. The intake valve 34 and the exhaust valve 33 are activated by respective rocker arms 35 and 36 which are hinged about the rocker arm pivots 37 and 38 driven by an eccentric cam 39 and 40 off the cam shafts 41 and 42 in synchronization with the secondary pistons 14 and 15.

Figure 4B:
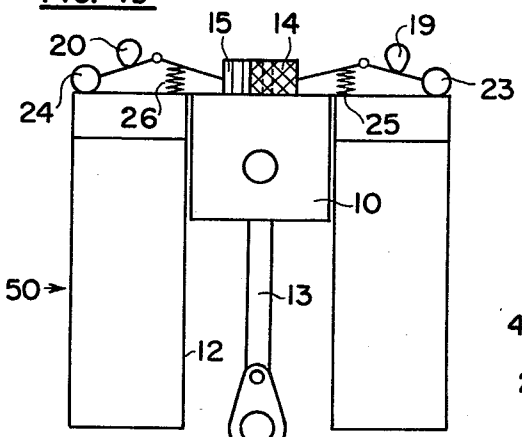
Figure 4A:
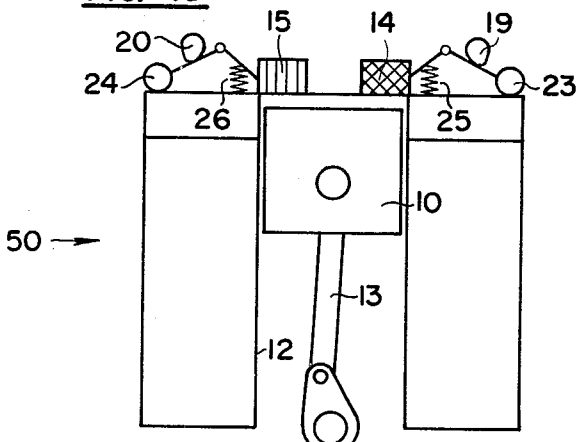
Figure 4D:
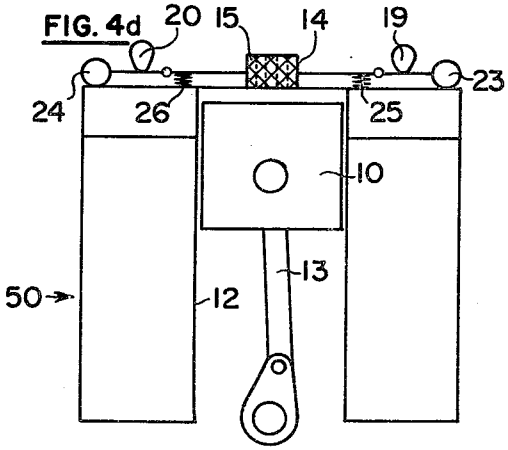
Figure 4C:
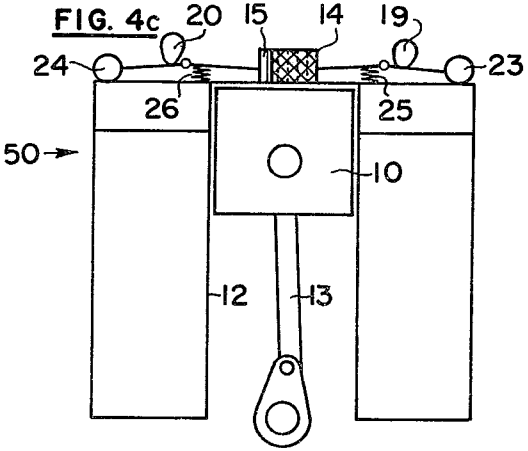
Figure 3:
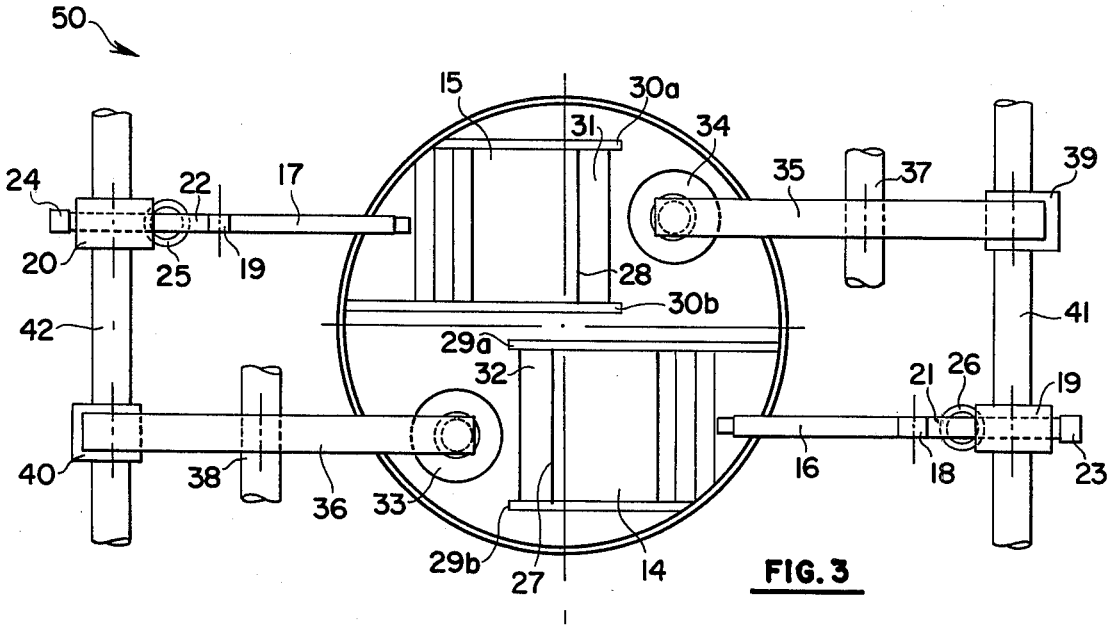
FIG. 3 is a top view showing schematically the operation and arrangement of the cylinders, and, FIGS. 4*a, b, c, d* are diagramatical illustrations of the operation of the engine during a combustion cycle.

The operation of the engine is depicted schematically in FIG. 4 wherein FIG. 4*a* shows the piston 10 at a point 10 degrees before top dead center with the secondary pistons in a withdrawn position. In FIG. 4*b* the main cylinder is at 0 degrees top dead center and the secondary pistons are still in a withdrawn position. At 5 degrees after top dead center, explosion within the cylinder occurs and the secondary pistons are shown in a forward position. The final FIG. 4*d* shows 10 degrees after top dead center on the compression stroke of the engine cylinder wherein the secondary pistons 14 and 15 are in a forward position. It is noted that 0 degrees represents the top most point of a circle in the aforementioned motion which is described by a rotating crank shaft.

When the cylinders 14 and 15 are in a forward position, combustion is generated by compression and since the force of the explosion is greater than with conventional ignition more power is developed per cylinder. Furthermore, there is more efficient combustion and less pollution results from the operation of the engine. As a further advantage, since the piston travel is adjusted at the factory, there is no need for future tuneups. Also, the secondary pistons have no rings which may wear out since they are movable with flat bars in a lateral direction. The engine as just described above may be used with various types of fuels including gasoline, diesel fuel, etc. and is simple and inexpensive to manufacture as well as having the aforementioned operating advantages.

While the invention has been explained by a detailed description of specific embodiments, it is understood that various modifications and substitutions can be made in any of them within the scope of the appended claims which are intended to include equivalents to such embodiments.

I claim:

1. In an engine having at least one conventional main engine cylinder with a piston mounted for travel within the chamber formed by the cylinder walls, the combination comprising:

a pair of opposed secondary pistons mounted side by side on the upper surface of the cylinder chamber, said pistons each including a chamber mounted over and coupled to the cylinder chamber and a plunger reciprocable therein and, a piston rod coupled to each secondary piston at one end and fixedly mounted at the other end, said piston rod comprising two portions pivotable about an intermediate point, eccentric means engaging and driving said pistons in a reciprocal motion and spring means mounted opposite said eccentric means for returning said secondary pistons to their initial position, separate means for operating said secondary pistons in conjunction with the main piston such that the plungers enter the respective chambers at a predetermined time interval to produce combustion of the fuel in the main engine cylinder by compression thereby eliminating the need for ignition of the fuel in the said cylinder.

2. An engine in accordance with claim 1 further including:

piston guide bars mounted on the upper surface of the engine cylinder within which the secondary pistons are movable, and an intake valve and an exhaust valve mounted on the upper surface of the engine cylinder, said valves being driven in synchronization with the secondary pistons and wherein the means for operating the secondary pistons comprises a rotating cam shaft having a cam means mounted on the shaft and separate linkage means engaging the valves and the secondary piston rods.

* * * * *